US005851373A

United States Patent [19]

Kubota et al.

[11] Patent Number: 5,851,373

[45] Date of Patent: Dec. 22, 1998

[54] METHOD FOR ANODIZING ALUMINUM MATERIAL

[75] Inventors: Hiroo Kubota; Yuzo Inukai, both of Shizuoka, Japan

[73] Assignee: Fuji Photo Film Co., Ltd., Minami-ashigara, Japan

[21] Appl. No.: 886,539

[22] Filed: Jul. 1, 1997

[51] Int. Cl.[6] ..... C25D 7/06; C25D 11/04

[52] U.S. Cl. ..... 205/139; 205/153; 205/324

[58] Field of Search ..... 205/139, 153, 205/324

[56] References Cited

U.S. PATENT DOCUMENTS

| | | | |
|---|---|---|---|
| 4,396,470 | 8/1983 | Atkinson | 204/38 |
| 4,554,057 | 11/1985 | Mohr | 204/29 |
| 4,554,216 | 11/1985 | Mohr | 428/469 |
| 4,566,952 | 1/1986 | Sprintschnick et al. | 204/27 |
| 4,606,975 | 8/1986 | Mohr | 428/469 |
| 4,872,946 | 10/1989 | Uesugi et al. | 205/139 |
| 5,181,997 | 1/1993 | Kaneko et al. | 204/129.1 |
| 5,207,881 | 5/1993 | Kaneko et al. | 204/211 |

FOREIGN PATENT DOCUMENTS

| | | |
|---|---|---|
| 47-18739 | 9/1972 | Japan . |
| 58-24517 | 5/1983 | Japan . |

*Primary Examiner*—Kathryn L. Gorgos
*Assistant Examiner*—Edna Wong
*Attorney, Agent, or Firm*—Burns, Doane, Swecker & Mathis, LLP

[57] ABSTRACT

A process for the anodization of an aluminum material which can form an anodized film free from local destruction or spalling even if supplied with electric current through the surface of the anodized film in the double-power supplied electrolytic process and/or multi-stage power supply electrolytic process to secure the desired quality and properties. A process for the anodization of an aluminum material can be provided, which comprises anodizing the surface of elongated aluminum or aluminum alloy which advances through a power supply part and an electrolytic part, and then supplying electric current to the surface of said anodized web through another power supply part in such a manner that the following relationships among the current density, the electric supply time and the amount of anodized film thus produced are satisfied:

$$(\text{Current density})^{4/3}\times(\text{Supply time})^{3/2}\times(\text{Amount of anodized film})^{2/3}\leqq 5{,}100 \quad (1)$$

$$1\leqq(\text{Supply time})\leqq 10, 0.5\leqq(\text{Amount of anodized film})\leqq 6.0 \quad (2)$$

wherein the current density, the supply time and the amount of anodized film are represented in $A/dm^2$, second and $g/m^2$, respectively.

16 Claims, 3 Drawing Sheets

PRIOR ART

METHOD FOR ANODIZING ALUMINUM MATERIAL

FIELD OF THE INVENTION

The present invention relates to a method for anodizing a web, wire or foil made of aluminum or aluminum alloy. More particularly, the present invention relates to an anodization process which can provide a solution to problems arising when electric power is supplied at the subsequent step to the surface of an anodized film which has once been formed on the surface of aluminum or aluminum alloy.

BACKGROUND OF THE INVENTION

The continuous electrolytic treatment of aluminum or its alloy (hereinafter referred to as "aluminum material") of continuous length has heretofore been put into practical use in a variety of applications such as anodization for use in the production of support for lithographic printing plate, anodized aluminum (alumite) wire, electrolytic capacitor, etc., electrolytic coloring, electrolytic polishing and electrolytic etching.

The continuous electrolytic treatment of aluminum material has heretofore been accomplished by an electrolytic process disclosed in JP-A-58-24517(The term "JP-A" as used herein means an "unexamined published Japanese patent application") and JP-A-47-18739. The electrolytic process is called submerged power-supplied electrolytic process.

An example of electrolytic apparatus using the submerged power-supplied process is illustrated in FIG. 5.

This electrolytic apparatus is adapted for anodization with d.c. current. This electrolytic apparatus comprises three parts, i.e., power supply part 2 for negatively charging an aluminum material 1, electrolytic part 3 for anodizing the negatively charged aluminum material 1 and middle part 4 provided to prevent shorting between the power supply part 2 and the electrolytic part 3. In the power supply part 2 and the electrolytic part 3, a power supply electrode 5 and an electrolytic electrode 6 are submerged in the electrolyte, respectively. The power supply electrode 5 and the electrolytic electrode 6 are connected to each other via a d.c. power source 7.

In such an anodizing apparatus, electric current at the d.c. power source flows from the power supply electrode 5 to the aluminum material 1 via the electrolyte in the power supply part 2. The electric current then flows toward the electrolytic part 3 through the aluminum material 1. In the electrolytic part 3, the electric current flows from the aluminum material 1 to the electrolytic electrode 6 via the electrolyte. In this arrangement, an anodized film is formed on the surface of the aluminum product 1 in the electrolytic part 3. In accordance with this submerged power-supplied process, the material to be processed is not allowed to come in contact with the electrode and other members as in direct power supply process. Thus, sparking during power supply, failure due to scratch or other troubles can be prevented, making it possible to realize a line having a high stability.

However, the foregoing anodizing apparatus has various disadvantages.

Firstly, the foregoing anodizing apparatus is disadvantageous in that the rise in the operating speed of the electrolytic line and the amount of anodized film cannot be invariably realized. In other words, when it is desired to raise the operating speed of the anodization line to enhance the productivity or the amount of anodized film to improve the quality of the product, the supplied amount of electric current must be raised. When the supplied amount of electric current is raised, the voltage drop due to ohmic loss in the aluminum material is raised. This makes it necessary to raise the electrolytic voltage of the power source.

When the electrolytic voltage of the power source is raised, the supplied amount of electric power is raised, raising the running cost and making it necessary to provide the power source with higher performance that requires increased facility cost. Further, the rise in the electrolytic voltage of the power source causes an increase in the amount of Joule heat generated in the aluminum material between the power supply electrode 5 and the electrolytic electrode 6. This causes an increase in the cost of cooling the aluminum material and the electrolyte to the normal predetermined temperature. Thus, such an apparatus which can operate at a higher speed in the electrolytic treatment line is extremely expensive.

Secondly, the foregoing anodizing apparatus is disadvantageous in that an aluminum material having a small section area can hardly be processed at a higher speed in the anodizing process. In other words, all the supplied amount of electric current flows through the aluminum material in the middle part between the power supply part and the electrolytic part. Therefore, when the supplied amount of electric current is raised, an aluminum material having a small section area such as a wire, foil or web generates heat more than required and then fuses. Accordingly, the amount of electric current which can be supplied to an aluminum material having a small section area is limited, making it difficult to raise the operating speed of the anodizing process and the amount of anodized film.

Thirdly, the foregoing anodizing apparatus is disadvantageous in that the pre-treatment apparatus for the anodizing apparatus must be prevented from corrosion, current leakage, etc. In other words, in the case where the anodizing process is followed by a process using an organic solvent such as coating process, it is a common practice that the aluminum product which has been passed through the anodizing process is grounded, e.g., via an earth roller to prevent the occurrence of ignition and explosion due to the rise in the potential of the aluminum material at the subsequent process.

In accordance with this countermeasure, the potential of the aluminum material can be kept almost to the earth potential at the process following the anodization bath. However, the potential of the aluminum material is higher at the process preceding the anodization bath than at the process following the anodization bath. Therefore, electric current flows backward through the aluminum material from the anodization bath and then returns to the d.c. power source via the pre-treatment apparatus and post-treatment apparatus to form a current circuit. This electric current gives various damages such as corrosion, sparking and current leakage on metallic parts used in piping and liquid supply pump in various processing apparatus provided for pre-treatment.

Accordingly, some countermeasures must be taken to prevent these troubles. For example, non-corrosive materials or insulating materials need to be used, requiring complicated facilities that add to the facility and maintenance costs. Further, when it is desired to raise the operating speed of the anodizing process for higher productivity or the amount of anodized film for higher quality, it is necessary to raise the supplied amount of electric current. This keeps the potential of the aluminum material higher at the process preceding the anodization bath than at the process following the anodization bath, raising a particularly remarkable problem.

Electrolytic apparatus which can give solutions to the foregoing problems to reduce drastically the running cost such as power cost and cooling cost and reduce the facility cost are disclosed in U.S. Pat. No. 5,181,997 and JP-A-4-280997 (corresponding to U.S. Pat. No. 5,207,881).

These processes are called double-power supplied electrolytic process because electric current is supplied into the electrolytic part through the pre-treatment part and the post-treatment part during electrolysis. An example of the electrolytic apparatus using this process is one using a process called power source sharing method or power source separation method. In further examples, a plurality of conventional units shown in FIG. 5 are longitudinally provided continuously or intermittently (2 units).

These electrolytic apparatus are adapted for anodization with d.c. current. These electrolytic apparatus comprise an electrolytic part for anodizing an aluminum material, pre-stage and post-stage power supply parts provided before and after the electrolytic apparatus (with respect to the running direction of the aluminum material), respectively, for supplying electric current to the aluminum material, and a pre-stage middle part and a post-stage middle part provided between the pre-stage power supply part and the electrolytic part and between the electrolytic part and the post-stage power supply part, respectively. The electrolytic part and pre-stage and post-stage power supply parts are filled with an electrolyte through which a sheet aluminum material advances.

In the foregoing electrolytic part is provided an electrolytic electrode. In the foregoing pre-stage and post-stage power supply parts are provided a pre-stage power supply electrode and a post-stage power supply electrode, respectively. The pre-stage and post-stage power supply electrodes are each connected to the plus terminal of the d.c. power source while the electrolytic electrode is connected to the minus terminal of the d.c. power source. Thus, the foregoing power source sharing method or power source separation method is accomplished by the difference in the connection of d.c. power source.

In the power source sharing method, the electric current flowing from the power source is automatically distributed to the pre-stage power supply part and the post-stage power supply part in such a proportion that the electrical resistance of the entire electrolytic apparatus comprising an aluminum material, an electrolyte, etc. is minimized.

In the power source separation method, an electric current passage comprising the pre-stage power supply electrode and the former half of the electrolytic electrode of the electrolytic part and an electric current passage comprising the post-stage power supply electrode and the latter half of the electrolytic electrode of the electrolytic part are formed. Therefore, any phenomenon involving the minimization of electrical resistance as in the power source sharing method doesn't occur. However, by properly distributing the electric current from a plurality of power sources to the pre-stage power supply part and the post-stage power supply part, the electrical resistance of the entire electrolytic apparatus can be almost minimized, though being inferior to the power source sharing method.

On the other hand, a series combination of a plurality of units shown in FIG. 5 is called multi-stage power supply electrolytic process. In an example of this process, a set of units comprising a first power supply part, a first middle part and a first electrolytic part arranged in this order is followed by another set of units comprising a second power supply part, a second middle part and a second electrolytic part arranged in this order.

In each of these sets, the electrolytic part and the power supply part are each filled with an electrolyte. In each of these electrolytic parts is provided an electrolytic electrode. In each of these power supply parts is provided a power supply electrode. The first power supply electrode is connected to the plus terminal of a d.c. power source while the first electrolytic electrode is connected to the minus terminal of the d.c. power source. Similarly, the second power supply electrode is connected to the plus terminal of another d.c. power source while the second electrolytic electrode is connected to the minus terminal of the d.c, power source.

In order to effect continuous electrolytic treatment in the foregoing continuous electrolytic apparatus, the aluminum material is allowed to advance while the d.c. power source is on. A d.c. current then flows from the power supply electrode in the power supply part to the aluminum material via the electrolyte. The electric current then flows to the electrolytic electrode via the electrolyte in the electrolytic part. The electric current then returns to the power source. Accordingly, the aluminum material acts as an anode in the electrolytic part to form an anodized film on the surface thereof opposed to the electrode.

In these continuous electrolytic apparatus, electric current is supplied to the electrolytic part via two routes, i.e., pre-stage power supply part or first power supply part and post-stage power supply part or second power supply part. Therefore, by making the amount of electric current supplied through the two routes equal to each other, the required amount of electric current may be half that through one of the two routes, making it possible to reduce the electrolytic voltage. Further, the use of the two routes reduces the distance over which electric current flows through the aluminum material. Accordingly, a small voltage may be used. Further, since the potential of the aluminum material which is entering into the electrolytic apparatus is lower than that in the case where one of the two routes is used, troubles such as corrosion of metallic parts used in piping and liquid supply pump, sparking and current leakage can be minimized.

Let us now give an example of the process for supplying electric current through the surface of the anodized film. A two-stage electrolytic treatment process which comprises anodizing a roughened aluminum plate in a sulfuric acid electrolyte, and then anodizing the aluminum plate in an electrolyte comprising sulfuric acid and phosphoric acid to improve the printing durability, developability and corrosiveness of a lithographic printing plate support made of aluminum or aluminum alloy is disclosed in U.S. Pat. No. 4,396,470.

U.S. Pat. No. 4,554,057 and JP-A-58-153699 (corresponding to U.S. Pat. No. 4,554,216) disclose a two-stage electrolytic process which comprises anodizing an aluminum material in a sulfuric acid-based electrolyte, and then anodizing the aluminum material in a water-soluble electrolyte comprising an anion containing phosphorus or a water-soluble electrolyte containing arsenic, vanadium, molybdenum, etc. This process makes it possible to enhance the alkali resistance of a chemically, mechanically and/or electrochemically roughened lithographic printing plate support. This process can be effected at a relatively high speed on a state-of-the-art belt type apparatus without adding to the production cost. This process exhibits little or no tendency for redissolution of oxide, making it possible to maintain the known definite properties of the anodized film produced by the anodization in a sulfuric acid solution.

JP-B-4-37159 (The term "JP-B" as used herein means an "examined Japanese patent publication") (corresponding to U.S. Pat. No. 4,566,952) discloses a two-stage electrolytic process which comprises anodizing an aluminum material in a phosphoric acid electrolyte, and then anodizing the aluminum material in a sulfuric acid electrolyte to prevent a mechanically, chemically and/or electrochemically roughened lithographic printing plate support from being fogged by a dye or the like, improve the contrast of image area with non-image area on the printing plate and enhance the alkali resistance of the support.

U.S. Pat. No. 4,606,975 discloses a two-stage electrolytic process which comprises anodizing an aluminum material in a phosphoric acid-free electrolyte, and then anodizing the aluminum material in a sulfuric acid electrolyte. This process can be allegedly effected at a high speed on a state-of-the-art production line without adding to the production cost to provide a mechanically, chemically and/or electrochemically roughened lithographic printing plate support excellent in alkali resistance.

However, the foregoing conventional submerged power-supplied electrolytic processes are disadvantageous in that when an aluminum material on which an anodized film has been formed at the electrolytic part is passed to the post-stage power supply part or the power supply part after the second stage unit in an electrolytic apparatus comprising a plurality of electrolytic units where it is then supplied with electric current (hereinafter referred to as "post-stage power supply process"), the anodized film may be locally destroyed and, in the extreme case, come off, making it impossible to form a uniform film on the surface of the aluminum material and hence provide the desired aluminum product.

The foregoing conventional submerged power-supplied electrolytic processes are also disadvantageous in that when a sheet aluminum material is anodized at the electrolytic part to form an anodized film thereon, electric current is concentrated on the edge of the sheet or escapes to the surface of the sheet opposite the anodized surface. Thus, an anodized film is formed more on the edge on the surface of the sheet opposed to the electrode and the other surface thereof. When the sheet is then supplied with electric current at the post-stage power supply part, the anodized film may more easily be destroyed or come off on the edge on the surface of the sheet opposed to the electrode and the other surface thereof than on the central part of the sheet, making it impossible to provide the desired product as in the foregoing case. On the other hand, no reference has been made to these problems and their solutions in the foregoing case of power supply through the surface of anodized film.

The electric current which has been supplied at the post-stage power supply part then flows through the anodized film into the aluminum material in the direction opposite to that at the electrolytic part. The passage of electric current in this direction is called cathodic polarization of anodized film. It is said that cathodic polarization causes local destruction of anodized film and dissolution of metal substrate to form pits therein. The possible mechanism of this phenomenon is as follows. In some detail, hydrogen ions in the electrolyte penetrate into the barrier layer in the anodized film through defects in the film. The hydrogen ions then discharge electricity at the metal substrate-barrier layer interface to produce a hydrogen gas. When the produced amount of hydrogen gas increases, the anodized film is destroyed. Electric current is concentrated on the destroyed points around which the pH value is increased to cause local dissolution.

Accordingly, it can be proposed that electric current be supplied only through the surface of the aluminum material free of anodized film (back face) to avoid the local destruction or spalling of the anodized film. However, this approach causes some problems, e.g., in the case where electrolytic treatment must be effected for aluminum materials having various width. In other words, if the power supply electrode is arranged so as to have a width of not more than the minimum width of the aluminum material to be anodized and extend longitudinally to secure the required area, the resulting facility not only becomes complicated but also adds to the line cost. Further, since the distance between the power supply electrode and the electrode in the electrolytic part is great, the voltage drop due to ohmic loss is increased, raising the required electrolytic voltage of the power source. As a result, the running cost is increased. Further, since the potential of the aluminum material is higher at the stage preceding the electrolytic bath, current leakage and other troubles can occur more frequently.

In the submerged power-supplied process, even if these problems can be solved, electric current escapes to the surface of the aluminum material opposed to the electrode, particularly on the edge. Thus, electric current is supplied into the aluminum material through the anodized film. Further, in some electrolytic apparatus, electric current escapes to the surface of the aluminum material opposite the anodized surface during anodization in the electrolytic part. Thus, an anodized film is formed not only on the edge of the surface of the sheet opposite the anodized surface but also on the central part thereof. Therefore, the supply of electric current through the anodized film cannot be completely prevented. Accordingly, the disposition of a power supply electrode only on the surface of the aluminum material opposite the anodized surface thereof is not particularly advantageous.

SUMMARY OF THE INVENTION

It is therefore an object of the present invention to provide a method for anodizing an aluminum material which can form an anodized film free from local destruction or spalling even if supplied with electric current through the surface of the anodized film in the double-power supplied electrolytic process and/or multi-stage power supply electrolytic process to secure the desired quality and properties.

The foregoing object of the present invention will become more apparent from the following detailed description and examples.

The foregoing object of the present invention is accomplished by a method for continuously anodizing an aluminum material, which comprises:

anodizing the surface of elongated aluminum or aluminum alloy which advances through a power supply part and an electrolytic part; and then supplying electric current to the surface of said anodized web through another power supply part in such a manner that the following relationships among the current density, the electric supply time and the amount of anodized film thus produced are satisfied:

$$(\text{Current density})^{4/3}\times(\text{Supply time})^{3/2}\times(\text{Amount of anodized film})^{2/3}\leqq 5{,}100 \quad (1)$$

$$1\leqq(\text{Supply time})\leqq 10, 0.5\leqq(\text{Amount of anodized film})\leqq 6.0 \quad (2)$$

wherein the current density, the supply time and the amount of anodized film are represented in $A/dm^2$, second and $g/m^2$, respectively.

BRIEF DESCRIPTION OF THE DRAWINGS

By way of example and to make the description more clear, reference is made to the accompanying drawings in which.

DETAILED DESCRIPTION OF THE INVENTION

The present invention provides an anodizing method which comprises further supplying electric current to aluminum or aluminum alloy which has been anodized at a power supply part and an electrolytic part through the anodized surface thereof.

Figure 2:
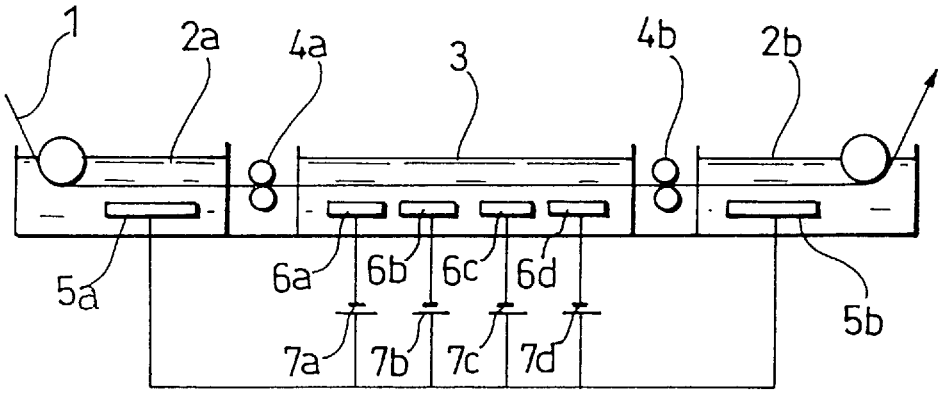
FIG. 2 is a schematic diagram illustrating an electrolytic apparatus for use in the power source sharing type double-power supplied electrolytic process to which the present invention can be applied.
Figure 3:
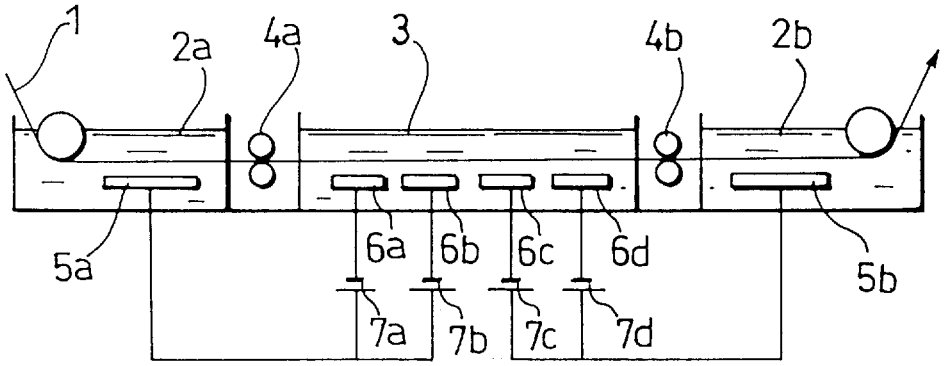
FIG. 3 is a schematic diagram illustrating an electrolytic apparatus for use in the power source separation type double-power supplied electrolytic process to which the present invention can be applied.

Examples of electrolytic apparatus for effecting the foregoing anodizing method are shown in FIGS. 2 and 3. A further example of such an electrolytic apparatus is one comprising two or more of the conventional unit shown in FIG. longitudinally connected to each other continuously or intermittently as shown in FIG. 4 (two-unit type).

The electrolytic apparatus shown in FIGS. 2 and 3 are adapted for anodization with d.c. current. These electrolytic apparatus each comprise an electrolytic part 3 for anodizing an aluminum web 1, a pre-stage power supply part 2*a* and a post-stage power supply part 2*b* provided before and after the electrolytic part 3 (with respect to the running direction of the aluminum material), respectively, for supplying electric current to the aluminum web 1, and a pre-stage middle part 4*a* and a post-stage middle part 4*b* provided between the pre-stage power supply part 2*a* and the electrolytic part 3 and between the electrolytic part 3 and the post-stage power supply part 2*b*, respectively.

The electrolytic part 3 and the pre-stage and post-stage power supply parts 2*a* and 2*b* are filled with an electrolyte. In the electrolytic part are provided electrolytic electrodes 6*a*, 6*b*, 6*c* and 6*d*. In the pre-stage and post-stage power supply parts 2*a* and 2*b* are provided pre-stage and post-stage power supply electrodes 5*a* and 5*b*, respectively. The pre-stage and post-stage power supply electrodes 5*a* and 5*b* are connected to the plus terminal of d.c. power sources 7*a*, 7*b*, 7*c* and 7*d* while the electrolytic electrodes 6*a*, 6*b*, 6*c* and 6*d* are connected to the minus terminal of the d.c. power sources 7*a*, 7*b*, 7*c* and 7*d*, respectively. The aluminum web 1 is arranged to advance through the electrolyte in the electrolytic part 3 and the pre-stage and post-stage power supply parts 2*a* and 2*b* from left to right as viewed on the drawing. By the difference in the connection of the d.c. power sources 7*a*, 7*b*, 7*c* and 7*d*, the process shown in FIG. 2 is referred to as "power source sharing process" while the process shown in FIG. 3 is referred to as "power source separation process".

Figure 4:
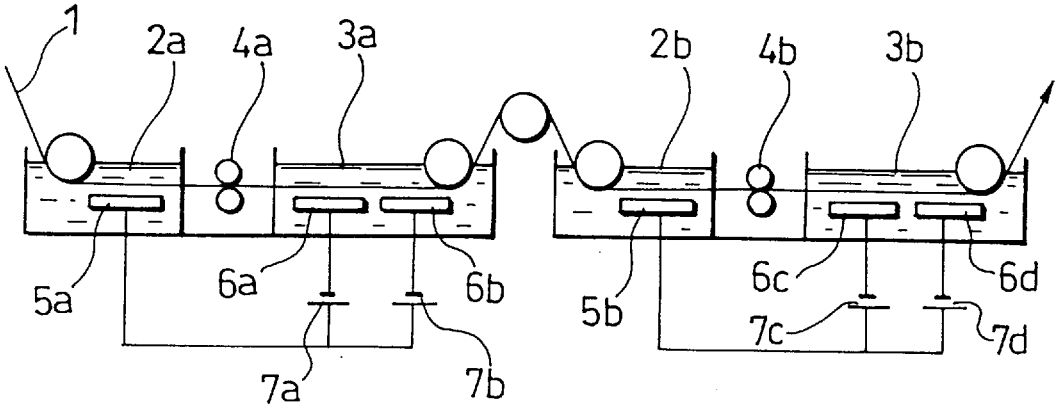
FIG. 4 is a schematic diagram illustrating an electrolytic apparatus for use in the two-stage power supply electrolytic process to which the present invention can be applied.
Figure 5:
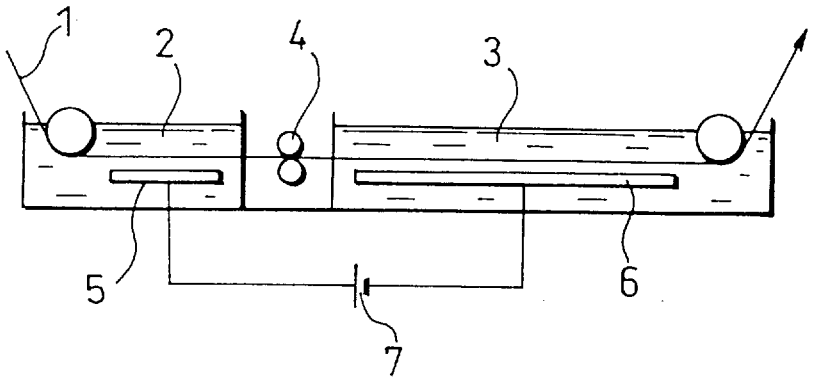
FIG. 5 is a schematic diagram illustrating an electrolytic apparatus for use in the conventional electrolytic process.

On the other hand, FIG. 4 illustrates an apparatus comprising a plurality of units of FIG. 5 connected to each other as mentioned above (referred to as "two-stage electrolytic process"). This apparatus comprises first and second electrolytic parts 3*a* and 3*b* for anodizing an aluminum web 1, first and second power supply parts 2*a* and 2*b* provided before the first and second electrolytic parts 3*a* and 3*b*, respectively, for supplying electric current to the aluminum web 1, and first and second middle parts 4*a* and 4*b* provided between the first power supply part 2*a* and the first electrolytic part 3*a* and between the second power supply part 2*b* and the second electrolytic part 3*b*, respectively. The apparatus shown in FIG. 4 employs a two-stage process. However, the number of stages is not specifically limited.

The electrolytic parts 3*a* and 3*b* and the first and second power supply parts 2*a* and 2*b* are filled with an electrolyte. In the electrolytic parts 3*a* and 3*b* are provided electrolytic electrodes 6*a* and 6*b* and electrolytic electrodes 6*c* and 6*d*, respectively. In the first and second power supply parts 2*a* and 2*b* are provided first and second electrodes 5*a* and 5*b*, respectively. The first power supply electrode 5*a* is connected to the plus terminal of d.c. power sources 7*a* and 7*b* while the first electrolytic electrodes 6*a* and 6*b* are connected to the minus terminal of the d.c. power sources 7*a* and 7*b*, respectively. Similarly, the second power supply electrode 5*b* is connected to the plus terminal of d.c. power sources 7*c* and 7*d* while the second electrolytic electrodes 6*c* and 6*d* are connected to the minus terminal of the d.c. power sources 7*c* and 7*d*, respectively.

In the electrolytic apparatus having the foregoing construction, electric current is possibly supplied to the aluminum web through the surface which has been anodized at the various electrolytic parts. When a plurality of power supply parts and electrolytic parts are connected in series to enhance the efficiency of anodization, electric current is unavoidably supplied through the anodized film, possibly causing a post-stage power supply that destroys or spalls anodized film. It is thought that the degree of this phenomenon depends on the produced amount of hydrogen gas, the escaped amount of hydrogen gas thus produced and the structure and strength of the film through which hydrogen gas escapes. Thus, extensive studies have been made of the destruction and spalling of anodized film.

As a result, it was found that the density of electric current flowing through the anodized film, the time during which electric current flows through the anodized film and the amount of anodized film which has been formed until such a phenomenon begins are closely related to each other. It was also found that when these conditions are properly selected, the anodized film undergoes neither destruction nor spalling.

In other words, it was found that when the density of electric current flowing at the post-stage power supply process is small, the time during which electric current flows at the post-stage process is short and the amount of anodized film formed at the pre-stage process (pre-stage power supply process for forming anodized film until the post-stage power supply process) is small, the anodized film is insusceptible to destruction and spalling. It was similarly found that when the post-stage current density is high, the post-stage power supply time is long and the amount of anodized film formed at the pre-stage power supply process is high, the anodized film can easily undergo destruction and spalling.

The amount of anodized film thus formed depends on the kind of aluminum material on which it is formed. In the case of anodized aluminum product, the thickness of anodized film thus formed is tens of micrometers. In the case of a lithographic printing plate support, the thickness of anodized film thus formed is about 1.3 μm at maximum. The destruction and spalling of anodized film is related to the amount of anodized film formed after the pre-stage power supply process. Thus, when the amount of anodized film thus formed is great, the anodized film can easily undergo destruction and spalling. On the contrary, when the amount of anodized film thus formed is small, the anodized film is insusceptible to destruction and spalling. In general, therefore, the amount of anodized film thus formed is advantageously small. However, the destruction and spalling of the anodized film doesn't depend on the amount of anodized film formed after the pre-stage power supply process alone. The destruction and spalling of the anodized film is related to the amount of anodized film thus formed as well as the post-stage current density and the post-stage power supply time.

For example, in the case where the amount of anodized film formed at the pre-stage power supply process is great, when the current density at the post-stage power supply process is small and the post-stage power supply time is short, the anodized film thus formed is insusceptible to destruction and spalling. In the case where the amount of anodized film formed at the pre-stage power supply process is small, when the current density at the post-stage power supply process is great and the post-stage power supply time is long, the anodized film thus formed can easily undergo destruction and spalling. Accordingly, it cannot be absolutely said that the amount of anodized film is advantageously small. The amount of anodized film to be formed on a lithographic printing plate support is almost unequivocally determined by the requirements for quality design such as printing properties. Therefore, the post-stage current density and the post-stage power supply time which cannot cause destruction and spalling of anodized film can be determined with the amount of anodized film fixed to the foregoing predetermined value.

In the submerged power-supplied process illustrated in FIGS. 2 and 3, electric current is supplied after the formation of the predetermined amount of anodized film at the electrolytic part. In the process illustrated in FIG. 4, electric current is supplied after the formation of about half the predetermined amount of anodized film. Accordingly, the amount of anodized film to be formed on a lithographic printing plate support is smaller than that to be formed on an anodized aluminum product. At present, it is from about 4.0 $g/m^2$ to 5.0 $g/m^2$ at maximum at the central part of the web. Therefore, in the case of double-power supplied electrolytic process, a support having an anodized film in an amount of from about 4.0 $g/m^2$ to 5.0 $g/m^2$ at maximum is supplied with electric current. In the case of two-stage power supplied electrolytic process, a support having an anodized film in an amount of from about 2.0 $g/m^2$ to 2.5 $g/m^2$ at maximum is supplied with electric current. However, an anodized film is formed greater at the edge of the web than at the central part of the web. When the support is supplied with electric current at the edge thereof at the same current density for the same time as effected at the central part of the web, the support can easily undergo destruction and spalling at the edge thereof. It is thus necessary that the current density and power supply time which don't cause destruction and spalling of anodized film be determined taking into account the amount of anodized film to be formed on the edge of the web as well. In the electrolytic part, an anodized film is formed also at the edge of the web on the surface thereof opposite the electrode. Therefore, these conditions need to be determined taking into account the anodized film thus formed as well.

In the post-stage power supply part, the electrodes may be disposed on both surfaces of the aluminum web or on either the anodized film surfaces of the aluminum web or the other surface of the aluminum web. The current density depends on the disposition of the electrodes relative to the aluminum web. For example, if the electrodes are disposed on both surfaces of an aluminum web, the area supplied with electric current is the sum of the product of the length of the electrode and the width of the aluminum web on both surfaces of the aluminum web. If the electrodes are disposed on one surface of the aluminum web, the area supplied with electric current is the product of the length of the electrode disposed on one either surface of the aluminum web and the width of the aluminum web. The current density is obtained by dividing the supplied amount of electric current by the area thus calculated.

However, if the power supply electrodes are disposed on both surfaces of the aluminum web, the current density differs from one surface to another because the anodized film exhibits an electrical resistance. Thus, the current density on the anodized film of the aluminum web is lower than that on the other surface. As the amount of anodized film increases, the current density on the anodized film of the aluminum web decreases further. Accordingly, in order to determine accurate current density on each surface of the aluminum web, it is necessary to investigate the proportion of electric current distributed to the anodized film and the other surface of the aluminum web for the various amounts of anodized film. In particular, the current density at the post-stage power supply process which doesn't cause destruction and spalling of anodized film at the edge of the web is determined by the amount of anodized film at the edge of the web, the amount of electric current required at the power supply part, the area supplied with electric current and the power supply time. If the double-power supplied electrolytic process and the two-stage power supply electrolytic process are conducted under the same power supply conditions, the two-stage power supply electrolytic process, which produces less anodized film during the post-stage power supply process, is favorable for the prevention of destruction and spalling of anodized film.

The post-stage power supply time is predetermined by the length of the power supply electrode and the running speed of the aluminum web. If it is desired to form a predetermined amount of anodized film, when the power supply electrode is long or the running speed of the aluminum web is low, the required power supply time is long, which is generally unfavorable for the prevention of destruction and spalling of anodized film. However, this involves a reduced amount of electric current and a reduced current density and is not necessarily unfavorable for the foregoing requirements. On the contrary, when the power supply electrode is short or the running speed of the aluminum web is high, the required power supply time is short, which is generally favorable for the prevention of destruction and spalling of anodized film. However, this involves a raised amount of electric current and a raised current density and is not necessarily favorable for the foregoing requirements. If the double-power supply electrolytic process and the two-stage power supply electrolytic process are conducted under the same power supply time conditions, the two-stage power supply electrolytic process, which produces less anodized film during the post-stage power supply process, is favorable for the prevention of destruction and spalling of anodized film.

Representative examples of the electrolyte through which electric current is supplied at the post-stage power supply process include an aqueous solution of sulfuric acid, phosphoric acid, oxalic acid, and salt thereof, and mixture thereof. The optimum electrolyte may be selected from these aqueous solutions to obtain the desired product quality. The concentration and temperature of the electrolyte may be freely selected. The electrolytic part and the power supply part may have the same or different electrolytes.

The optimum waveform of electric current supplied from the power source may be selected from the group consisting of d.c. wave, a.c. wave and a.c.-superimposed d.c. wave to obtain the desired product quality.

As the aluminum web there may be used any aluminum material to be subjected to anodization. In particular, as the aluminum material for a lithographic printing plate support there may be used any known aluminum plate such as JIS A1050 and JIS A1100. If necessary, the foregoing aluminum materials may be subjected to pretreatment, etching and mechanical, chemical or electrochemical roughening by a known technique. The aluminum material thus treated is then subjected to anodization according to the present invention. In particular, if it is used as a lithographic printing plate support, the aluminum material is then subjected to known hydrophilic treatment as necessary. If necessary, the aluminum material is then provided with an undercoating layer, a photosensitive resin layer and a matting layer. In this manner, the desired photosensitive lithographic printing plate can be prepared.

As has been mentioned above, the destruction and spalling of anodized film during the post-stage power supply process is closely related to the amount of anodized film formed during the power supply process, the current densityand the power supply time. Thus, these conditions cannot be unequivocally determined. Accordingly, the relationship among these conditions needs to be made clear. Aluminum plates which had been subjected to pretreatment, etching, and mechanical, chemical and electrochemical roughening were subjected to anodization to prepare various samples having different amounts of anodized film formed thereon. These samples were then supplied with electric current at various current densities for various periods of time at the post-stage power supply process. These samples were each analyzed and evaluated for destruction and spalling. As a result, it was found that if the relationship among the amount of anodized film, the power supply time and the current density satisfies the foregoing experimental equation, the anodized film undergoes neither destruction nor spalling.

In other words, the condition under which the anodized film undergoes neither destruction nor spalling during the post-stage power supply process can be defined by the relationship that the product of (current density)$^{4/3}$, (power supply time)$^{3/2}$ and (amount of anodized film)$^{2/3}$ is not more than 5,100. It can be said that the destruction and spalling of anodized film can be affected by power supply time, current density and amount of anodized film, which increase in that order. The power supply time and amount of anodized film have a predetermined range. This means that if the foregoing conditions are not satisfied, the anodized film undergoes destruction and spalling in the case of a lithographic printing plate support in particular.

In the case of a lithographic printing plate support, the amount of anodized film to be formed thereon is preferentially determined from the standpoint of quality design. Therefore, the power supply time and post-stage current density can be most suitably determined. This means that, for example, if the required amount of anodized film is 4.0 g/m$^2$, which requires that the anodized film occurs in an amount of 4.0 g/m$^2$ during the post-stage power supply process in the double-power supplied electrolytic process, the power supply time may be 8 seconds, 6 seconds or 4 seconds so that the density of electric current supplied through the anodized film is determined to not more than about 29.1 [A/dm$^2$], not more than about 40.2 [A/dm$^2$] or not more than about 63.4 [A/dm$^2$], respectively, which causes neither destruction nor spalling of anodized film.

In the two-stage power supply electrolytic process, in order to reduce the power cost, the amount of electric current supplied into the first stage and second stage electrolytic parts may be equal to each other. Since the anodized film formed at the first stage electrolytic part exists in an amount of 2.0 g/m$^2$ when supplied with electric current at the post-stage power supply process at the second stage electrolytic part, the power supply time may be 8 seconds, 6 seconds or 4 seconds so that the density of electric current supplied through the anodized film is determined to be not more than about 41.1 [A/dm$^2$], not more than about 56.8 [A/dm$^2$] or not more than about 89.7 [A/dm$^2$], respectively, which causes neither destruction nor spalling of anodized film. From the standpoint of density of electric current supplied at the post-stage power supply process, the two-stage power supply electrolytic process is favorable for the prevention of destruction and spalling of anodized film.

By investigating the relationship of power supply time and current density to the desired amount of anodized film as mentioned above, the optimum power supply time and current density which don't cause destruction and spalling of anodized film during the post-stage power supply step can be selected.

Specific examples and comparative examples of the process for the anodization of an aluminum material according to the present invention will be described hereinafter in connection with the appended drawings to give the basis for the foregoing relationship. However, the following specific examples are intended to deepen the understanding of the present invention. The present invention is not limited to these specific examples.

EXAMPLES

Using an anodizing apparatus having the construction shown in FIG. 5 (length of electrolytic part: 12 m; length of power supply part: 3 m) and a continuous aluminum web treatment apparatus (not described in detail) comprising a mechanical roughening apparatus, an etching apparatus and an electrochemical roughening apparatus, aluminum webs having a thickness of 0.24 mm and a width of 1,000 mm were anodized with varied supplied amounts of electric current while being conveyed at a speed of 36 m/min to form anodized films thereon in an amount of 0.8 g/m$^2$, 1.5 g/m$^2$, 2.5 g/m$^2$, 4.0 g/m$^2$ and 5.5 g/m$^2$, respectively. These anodized aluminum webs were each then wound. These anodized aluminum webs were each then cut while being unwound to give normally anodized samples (Samples A, B, C, D and E).

As the electrolyte there was used an aqueous solution of sulfuric acid common to the electrolytic part and the power supply part. The treatment in the apparatus other than the anodizing apparatus was fixed.

Figure 1:
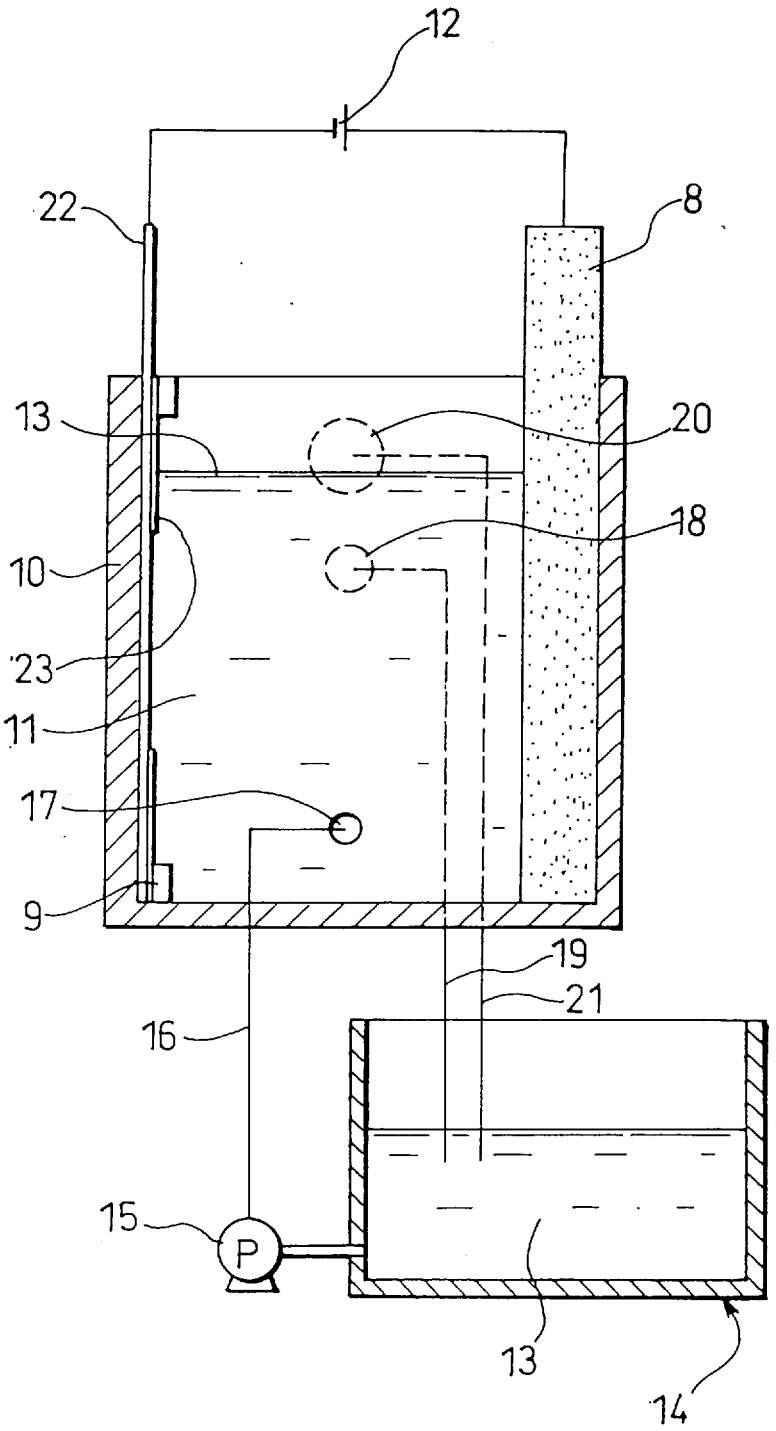
FIG. 1 is a schematic diagram illustrating an experimental electrolytic apparatus for post-stage anodization.

Using an electrolytic apparatus as shown in FIG. 1, the foregoing samples were each treated with varied supplied amounts of electric current (current density) and varied power supply times.

The foregoing electrolytic apparatus comprises an electrolytic bath 11 composed of an electrode 8 made of carbon, a sample fixture 9 and a treatment bath 10, a d.c. power source 12, a reservoir 14 for storing an electrolyte 13, and a pump 15 for circulating the electrolyte 13. The electrolyte 13 is supplied into the treatment bath 10 through a feed pipe 16 and an electrolyte inlet 17 on the treatment bath 10. The electrolyte 13 thus supplied is mainly returned to the reservoir 14 through an electrolyte outlet 18 and a return pipe 19. The other part of the electrolyte 13 is returned to the reservoir 14 through an overflow port 20 and an overflow pipe 21. The electrolyte 13 in the reservoir 14 is controlled to a predetermined temperature by means of a controller (not shown).

The electrode 8 in the electrolytic bath 11 is connected to the plus terminal of the d.c. power source 12. The sample is connected to the minus terminal of the d.c. power source. When electric current is supplied from the d.c. power source 12 under these conditions, it flows through the electrode 8 and the electrolyte 13. The electric current then flows into a sample 22 through an anodized film on the area (power-supplied area) other than that covered by an insulating tape 23. The electric current then flows back to the d.c. power source 12. The distance between the electrode 8 and the sample 22 was 50 mm. As the electrolyte 13 there was used an aqueous solution of sulfuric acid (concentration of sulfuric acid: 150 g/l; temperature: 35° C.). The sample 22 was covered by a plastic insulating tape 23 on the submerged area other than the power-supplied area so that electric current was passed through the power-supplied area alone. The power-supplied area was 25 $cm^2$.

For the evaluation of the resistance of these power-supplied samples to destruction and spalling, the following methods were employed. In some detail, a table having a corner with an angle of 150° degrees and radius R of 2 mm was prepared. The sample was pressed against the corner of the table with the anodized surface thereof upside so that it was folded at an angle of 30 degrees. The sample was turned over, and then pressed against the table with the folded point put on the corner so that it was folded the other way by 60° degrees. The sample was turned over, and then folded the other way by 30° degrees with the folded point put on the corner until it was flat. The sample thus folded was cracked.

An adhesive tape was then applied to the sample on the folded point in the manner described in ARS (Aluminum Research Standard: test specification by Association of Research of Surface Treatment of Aluminum) 141, one of methods for testing the adhesivity of coating film. The adhesive tape was then peeled off the sample. The sample was then observed for destruction and spalling of anodized film at the folded point by a scanning electron microscope (SEM).

Example 1

Samples A, B, C, D and E were each supplied with electric current for 1 second, 3 seconds, 5 seconds, 8 seconds and 10 seconds. The results of evaluation of these samples are set forth in Tables 1, 2, 3, 4 and 5. As a comparative sample there was used a sample which had not been supplied with electric current. The blanks in these tables mean that no samples were prepared or evaluated. The symbols have the following meaning:

G: No spalling occurred; F: Some spalling occurred; P: Spalling occurred

TABLE 1

Results of observation of spalling in power-supplied samples (power supply time: 1 sec.)

| Power supply | | Supplies amount of electric current (A) | | | | | | | | | | | | | |
|---|---|---|---|---|---|---|---|---|---|---|---|---|---|---|---|
| time | Sample | 45 | 50 | 55 | 60 | 80 | 100 | 120 | 130 | 140 | 160 | 170 | 180 | 200 | 220 |
| 1 sec. | A | | | | | | | | | G | G | G–F | F | P | |
| | B | | | | | | G | G | F–P | P | | | | | |
| | C | | | | G | G | F | P | | | | | | | |
| | D | | | G | G | G–F | P | | | | | | | | |
| | E | | G | G | G | F–P | P | | | | | | | | |

TABLE 2

Results of observation of spalling in power-supplied samples (power supply time: 3 sec.)

| Power supply | | Supplies amount of electric current (A) | | | | | | | | | | | | | |
|---|---|---|---|---|---|---|---|---|---|---|---|---|---|---|---|
| time | Sample | 12 | 14 | 16 | 18 | 20 | 25 | 30 | 35 | 40 | 45 | 50 | 55 | 60 | 80 |
| 3 sec. | A | | | | | | | | | G | G | G–F | F–P | P | |
| | B | | | | | | G | G | G | F–P | P | P | | | |
| | C | | | | | G | G | F | P | P | | | | | |
| | D | | | | G | G | F–P | P | P | | | | | | |
| | E | | G | G | G | G–F | P | | | | | | | | |

TABLE 3

Results of observation of spalling in power-supplied samples (power supply time: 5 sec.)

| Power supply time | Sample | Supplies amount of electric current (A) 4 | 6 | 8 | 10 | 12 | 14 | 16 | 18 | 20 | 25 | 30 | 35 | 40 | 45 |
|---|---|---|---|---|---|---|---|---|---|---|---|---|---|---|---|
| 5 sec. | A | | | | | | | | | G | G | F | P | P | |
| | B | | | | | | | | G | G | F–P | P | P | | |
| | C | | | | | | G | G | F | P | P | | | | |
| | D | | | | G | G | F–P | P | P | | | | | | |
| | E | | G | G | G | F–P | P | | | | | | | | |

TABLE 4

Results of observation of spalling in power-supplied samples (power supply time: 8 sec.)

| Power supply time | Sample | Supplied amount of electric current (A) 4 | 6 | 8 | 10 | 12 | 14 | 16 | 18 | 20 | 25 |
|---|---|---|---|---|---|---|---|---|---|---|---|
| 8 sec. | A | | | | | | G | G | F–P | P | |
| | B | | | G | G | G–F | F–P | P | | | |
| | C | | G | G | F | P | | | | | |
| | D | | G | G–F | P | | | | | | |
| | E | G | G | P | | | | | | | |

TABLE 5

Results of observation of spalling in power-supplied samples (power supply time: 10 sec.)

| Power supply time | Sample | Supplied amount of electric current (A) 4 | 6 | 8 | 10 | 12 | 14 | 16 | 18 | 20 |
|---|---|---|---|---|---|---|---|---|---|---|
| 10 sec. | A | | | | G | G | F | F–P | P | |
| | B | | G | G | F | P | | | | |
| | C | G | G | G–F | P | | | | | |
| | D | G | G–F | P | | | | | | |
| | E | G | F–P | P | | | | | | |

The resulting supplied amount of electric current (A) was converted to current density (A/dm$^2$). The relationship among current density, power supply time (sec.) and amount of anodized film (g/m$^2$) which doesn't cause destruction and spalling of anodized film was determined and represented by the foregoing experimental equation.

Example 2

Using an aluminum web continuous treatment apparatus (not described in detail) comprising a power source separation type double-power supplied electrolytic process anodizing apparatus (length of electrolytic part: 12 m; length of pre-stage power supply part: 3 m; length of post-stage power supply part: 3 m; length of pre-stage and post-stage power supply electrodes: 2.4 m) having the construction shown in FIG. 3, a mechanical roughening apparatus, an etching apparatus and an electrochemical roughening apparatus, an aluminum web having a thickness of 0.24 mm and a width of 1,000 mm was anodized while being conveyed at a speed of 36 m/min. to form an anodized film thereon in an amount of 2.4 g/m$^2$, and then was wound.

During this process, in the anodizing apparatus, electric current from the power sources 7*a* and 7*b* flow into the pre-stage power supply electrode 5*a* provided in the pre-stage power supply part 2*a*. The electric current then flows to the aluminum web through the electrolyte. Under these conditions, an anodized film is formed on the surface of the aluminum web in the electrolytic part 3. The electric current is then returned to the power source through the electrolytic electrodes 6*a* and 6*b* provided in the electrolytic part 3. On the other hand, electric current from the power sources 7*c* and 7*d* flow into the post-stage power supply electrode 5*b* provided in the post-stage power supply part 2*b*. The electric current then flows into the aluminum web through the electrolyte so that an anodized film is formed on the surface of the aluminum web in the electrolytic part 3. The amount of electric current to be supplied from the power sources 7*a* and 7*b* into the pre-stage power supply part 2*a* was adjusted the same as the amount of electric current to be supplied from the power sources 7*c* and 7*d* into the post-stage power supply part 2*b*. The density of electric current supplied through the anodized film in the post-stage power supply part 2*b* was about 23 (A/dm$^2$). In the post-stage power supply part 2*b*, electric current was supplied into the aluminum web through the area which had been anodized in an amount of 2.4 g/m$^2$. The treatment conditions other than electrolyte and anodizing apparatus were the same as in Example 1.

The sample thus anodized was then cut while being unwound to give Sample F. Sample F was then evaluated for anodized film properties in the same manner as in Example 1. As a result, the anodized film was found to undergo neither destruction nor spalling at the central part and edge of the sample.

Example 3

The procedure of Example 2 was followed to effect anodization except that a power source sharing type double-power supplied electrolytic process anodizing apparatus (length of electrolytic part: 12 m; length of pre-stage power supply part: 3 m; length of post-stage power supply part: 3 m; length of pre-stage and post-stage power supply electrodes: 2.4 m) was employed in which the plus terminal of the power sources 7*a*, 7*b*, 7*c* and 7*d* were all connected to the power supply electrodes 5*a* and 5*b* so that electric current from these power sources were supplied into the pre-stage power supply electrode 5*a* and the post-stage power supply electrode 5*b*. Thus, an anodized film was formed on an aluminum web in an amount of 2.4 g/m$^2$. The aluminum web thus anodized was then wound.

During this process, in the anodizing apparatus, electric current from the power sources 7*a*, 7*b*, 7*c* and 7*d* is distributed to the pre-stage power supply part 2*a* and the post-stage power supply part 2*b* in such a manner that the electrical resistance of the entire anodizing apparatus is minimized. The electric current which has flown into the pre-stage power electrode 5*a* provided in the pre-stage power supply part 2*a*, and then flown into the aluminum web through the electrolyte causes the aluminum web to be anodized on the surface thereof in the electrolytic part 3. The electric current is then returned to the power sources through any of the electrolytic electrodes 6*a*, 6*b*, 6*c* and 6*d* provided in the electrolytic part 3.

On the other hand, the electric current which has flown into the post-stage power electrode 5*b* provided in the post-stage power supply part 2*b*, and then flown into the aluminum web through the electrolyte causes the aluminum web to be anodized on the surface thereof in the electrolytic part 3. The electric current is then returned to the power sources through any of the electrolytic electrodes 6*a*, 6*b*, 6*c* and 6*d* provided in the electrolytic part 3. The amount of electric current to be supplied from the power sources 7*a* and 7*b* into the pre-stage power supply part 2*a* was adjusted the same as the amount of electric current to be supplied from the power sources 7*c* and 7*d* into the post-stage power supply part 2*b*. The density of electric current to be supplied through the anodized film in the post-stage power supply part 2*b* is estimated to be about 23 (A/dm$^2$), but this is not accurate. In the post-stage power supply part 2*b*, electric current was supplied into the aluminum web through the area which had been anodized in an amount of 2.4 g/m$^2$.

The sample thus anodized was then cut while being unwound to give Sample G. Sample G was then evaluated for anodized film properties in the same manner as in Example 1. As a result, the anodized film was found to undergo neither destruction nor spalling at the central part and edge of the sample.

Example 4

Using a continuous aluminum web treatment apparatus (not described in detail) comprising a two-stage power supply electrolytic process anodizing apparatus (length of first and second electrolytic parts: 6 m each; length of first and second power supply parts: 3 m each; length of first and second power supply electrodes: 2.4 m each) having the construction shown in FIG. 4, a mechanical roughening apparatus, an etching apparatus and an electrochemical roughening apparatus, an aluminum web having a thickness of 0.24 mm and a width of 1,000 mm was anodized while being conveyed at a speed of 36 m/min. to form an anodized film thereon in an amount of 2.4 g/m$^2$, and then wound.

During this process, in the anodizing apparatus, electric current from the power sources 7*a* and 7*b* flow into the first power supply electrode 5*a* provided in the first power supply part 2*a*. The electric current then flows to the aluminum web through the electrolyte. Under these conditions, an anodized film is formed on the surface of the aluminum web in the first electrolytic part 3*a*. The electric current is then returned to the power sources through the electrolytic electrodes 6*a* and 6*b* provided in the first electrolytic part 3*a*.

On the other hand, electric current from the power sources 7*c* and 7*d* flows into the second power supply electrode 5*b* provided in the second power supply part 2*b*. The electric current then flows into the aluminum web through the electrolyte so that an anodized film is formed on the surface of the aluminum web in the second electrolytic part 3*b*. The amount of electric current to be supplied from the power sources 7*a* and 7*b* into the first power supply part 2*a* was adjusted the same as the amount of electric current to be supplied from the power sources 7*c* and 7*d* into the second power supply part 2*b*. The density of electric current supplied through the anodized film in the second power supply part 2*b* was about 23 (A/dm$^2$). In the second power supply part 2*b*, electric current was supplied into the aluminum web through the area which had been anodized in an amount of 1.2 g/m$^2$. The treatment conditions other than electrolyte and anodizing apparatus were the same as in Example 1.

The sample thus anodized was then cut while being unwound to give Sample H. Sample H was then evaluated for anodized film properties in the same manner as in Example 1. As a result, the anodized film was found to undergo neither destruction nor spalling at the central part and edge of the sample.

In accordance with the present invention, when electric current is supplied into the aluminum web through the anodized film in the post-stage power supply part, the conditions such as current density, amount of anodized film and power supply time can be optimized to prevent local destruction and spalling of anodized film, making it possible to form a uniform anodized film. Thus, an aluminum product which satisfies quality and property requirements can be provided. Further, the process according to the present invention can be operated at a reduced power. Thus, the cooling burden and running cost can be reduced. Moreover, no power source having great boosting properties is required. Further, troubles such as corrosion, spark and current leakage can be minimized.

While the invention has been described in detail and with reference to specific embodiments thereof, it will be apparent to one skilled in the art that various changes and modifications can be made therein without departing from the spirit and scope thereof.

What is claimed is:

1. A method for continuously anodizing a surface of an elongated aluminum or aluminum alloy web, which comprises:

anodizing the surface of the web which advances through a power supply part and an electrolytic part to form an anodized web; and then supplying electric current to the surface of said anodized web through another power supply part in such a manner that the following relationships among current density, electric supply time and amount of anodized film thus produced are satisfied:

$$(\text{Current density})^{4/3}\times(\text{Supply time})^{3/2}\times(\text{Amount of anodized film})^{2/3}\leqq 5{,}100 \quad (1)$$

$$1\leqq(\text{Supply time})\leqq 10, 0.5\leqq(\text{Amount of anodized film})\leqq 6.0 \quad (2)$$

wherein the current density, the supply time and the amount of anodized film are represented in A/dm$^2$, second and g/m$^2$, respectively.

2. A method as claimed in claim 1, wherein said amount of anodized film is in the range of 0.8 g/m$^2$ to 5.5 g/m$^2$.

3. A method as claimed in claim 2, wherein said aluminum web is electrolytically treated through a power source sharing double-power supplied electrolytic apparatus.

4. A method as claimed in claim 2, wherein said aluminum web is electrolytically treated through a power source separation double-power supplied electrolytic apparatus.

5. A method as claimed in claim 2, wherein said aluminum web is electrolytically treated through a two-stage power supply electrolytic apparatus.

6. A method as claimed in claim 1, wherein said amount of anodized film is in the range of 1.5 g/m$^2$ to 4 g/m$^2$.

7. A method as claimed in claim 6, wherein said aluminum web is electrolytically treated through a power source sharing double-power supplied electrolytic apparatus.

8. A method as claimed in claim 6, wherein said aluminum web is electrolytically treated through a power source separation double-power supplied electrolytic apparatus.

9. A method as claimed in claim 6, wherein said aluminum web is electrolytically treated through a two-stage power supply electrolytic apparatus.

10. A method as claimed in claim 1, wherein said amount of anodized film is in the range of 1.5 $g/m^2$ to 2.5 $g/m^2$.

11. A method as claimed in claim 10, wherein said aluminum web is electrolytically treated through a power source sharing double-power supplied electrolytic apparatus.

12. A method as claimed in claim 10, wherein said aluminum web is electrolytically treated through a power source separation double-power supplied electrolytic apparatus.

13. A method as claimed in claim 10, wherein said aluminum web is electrolytically treated through a two-stage power supply electrolytic apparatus.

14. A method as claimed in claim 1, wherein said aluminum web is electrolytically treated through a power source sharing double-power supplied electrolytic apparatus.

15. A method as claimed in claim 1, wherein said aluminum web is electrolytically treated through a power source separation double-power supplied electrolytic apparatus.

16. A method as claimed in claim 1, wherein said aluminum web is electrolytically treated through a two-stage power supply electrolytic apparatus.

* * * * *

UNITED STATES PATENT AND TRADEMARK OFFICE

CERTIFICATE OF CORRECTION

PATENT NO. : 5,851,373

DATED : December 22, 1998

INVENTOR(S) : Hiroo KUBOTA, et al.

It is certified that error appears in the above-indentified patent and that said Letters Patent is hereby corrected as shown below:

On the title page, item [30] should read:

Foreign Application Priority Data

July 2, 1996 [JP] Japan ..... 8-172513

Signed and Sealed this

Eighth Day of June, 1999

*Attest:*

Q. TODD DICKINSON

*Attesting Officer*

*Acting Commissioner of Patents and Trademarks*